US008898977B2

(12) United States Patent
Gulino

(10) Patent No.: US 8,898,977 B2
(45) Date of Patent: Dec. 2, 2014

(54) WEDGE-LOCK QUOIN CORNER ASSEMBLY

(71) Applicant: Francesco Gulino, Collegeville, PA (US)

(72) Inventor: Francesco Gulino, Collegeville, PA (US)

( * ) Notice: Subject to any disclaimer, the term of this patent is extended or adjusted under 35 U.S.C. 154(b) by 0 days.

(21) Appl. No.: 13/836,475

(22) Filed: Mar. 15, 2013

(65) Prior Publication Data

US 2014/0260020 A1 Sep. 18, 2014

(51) Int. Cl.
*E04B 2/00* (2006.01)
*E04D 1/00* (2006.01)
*E04F 13/073* (2006.01)

(52) U.S. Cl.
CPC ..... *E04F 13/0733* (2013.01)
USPC ..... 52/287.1; 52/523; 52/539

(58) Field of Classification Search
CPC . E04F 13/076; E04F 13/0889; E04F 13/0894; E04F 13/082; E04F 15/02038; E04F 2201/02; E04F 2201/022; E04F 2201/03; E04F 2201/048
USPC ..... 52/287.1, 539, 536, 523, 596, 592.3
See application file for complete search history.

(56) References Cited

U.S. PATENT DOCUMENTS

| | | | | |
|---|---|---|---|---|
| 4,915,344 | A | 4/1990 | Polak | |
| 5,675,955 | A | 10/1997 | Champagne | |
| 5,685,119 | A | 11/1997 | Zschoppe | |
| 5,836,123 | A * | 11/1998 | Gulino | 52/288.1 |
| 6,715,250 | B2 | 4/2004 | Bryant et al. | |
| 6,725,618 | B2 | 4/2004 | Albracht | |
| 6,860,024 | B2 | 3/2005 | Kirk | |
| 7,673,393 | B1 | 3/2010 | Hudson | |
| 7,793,474 | B2 | 9/2010 | Tyler et al. | |
| 7,856,790 | B2 | 12/2010 | Jambois et al. | |
| 7,900,414 | B2 | 3/2011 | Seccombe | |
| 7,954,292 | B2 * | 6/2011 | Holt et al. | 52/309.8 |
| 7,980,037 | B2 | 7/2011 | Trabue et al. | |
| 8,074,417 | B2 | 12/2011 | Trabue et al. | |
| 8,141,830 | B1 | 3/2012 | Hudson | |
| 8,209,938 | B2 | 7/2012 | Gaudreau et al. | |
| 8,607,516 | B2 * | 12/2013 | O'Brien | 52/287.1 |

(Continued)

OTHER PUBLICATIONS

Wikipedia: Quoin (Architecture) http://en.wikipedia.org/wiki/Ouoin_%28architecture%29 downloaded Jul. 4, 2012.

(Continued)

*Primary Examiner* — Andrew J Triggs
(74) *Attorney, Agent, or Firm* — Gerry J. Elman; Elman Technology Law, P.C.

(57) ABSTRACT

This prefabricated locking quoin block is used to construct the surface of buildings. The surface of the block has decorative portions resembling brick, stone, wood, or other construction materials. Preferably the surface of each block has both a raised and a recessed decorative portion, so as to form, when assembled, a quoin corner assembly resembling sawn or quarried stone blocks. Installers can attach the assemblies to conventional building structures and install cladding materials such as vinyl siding without needing to alter the blocks other than to adjust the base block for height. The block includes wedge locks to securely connect adjacent blocks matingly to each other. Installers thereby are able to assemble a secure stack of quoin corner blocks and attach it to a building with few additional steps, saving time, labor, and cost in construction.

10 Claims, 7 Drawing Sheets

(56) References Cited

U.S. PATENT DOCUMENTS

| | | | | |
|---|---|---|---|---|
| 2002/0189187 | A1 | 12/2002 | Bryant et al. | |
| 2003/0056457 | A1 | 3/2003 | Zeeff | |
| 2003/0079437 | A1 | 5/2003 | Near | |
| 2004/0074188 | A1 | 4/2004 | Beck et al. | |
| 2005/0072093 | A1 | 4/2005 | King | |
| 2007/0130878 | A1 | 6/2007 | Davis | |
| 2007/0137127 | A1* | 6/2007 | Lincoln et al. | 52/384 |
| 2007/0251177 | A1 | 11/2007 | Frahm et al. | |
| 2010/0088988 | A1 | 4/2010 | Gaudreau | |
| 2011/0289874 | A1* | 12/2011 | O'Brien | 52/287.1 |

OTHER PUBLICATIONS

Quoin corner stone http://www.sandstoneworld.com/sandtone-quoin.htm downloaded Jul. 4, 2012.

Quoin corner stone http://www.thorvertonstone.co.uk/quoins.cfm downloaded Jul. 4, 2012.

Gormley Heritage Conservation District Plan http://www.richmondhill.ca/documents/gormley_hcd_plan.pdf downloaded Jul. 5, 2012 p. 59 of PDF shows and describes proper quoin corner made of bricks.

* cited by examiner

WEDGE-LOCK QUOIN CORNER ASSEMBLY

BACKGROUND OF THE INVENTION

1. Technical Field

My invention pertains to building construction, specifically constructing decorative and protective corners of building surfaces.

2. Related Art

Vinyl siding is a popular material for constructing the surfaces of buildings, due to its reasonable cost and low maintenance. However, in the past, the corners of most buildings with vinyl siding or other cladding have been simple vertical strips with little adornment. I invented and patented a vinyl-siding corner block to enhance the look of those buildings. See my U.S. Pat. No. 5,836,123.

BRIEF SUMMARY OF THE INVENTION

Though my vinyl-siding corner blocks worked well, I more recently realized they could be even better. Builders had to attach them to a building one at a time. Also, though they could fit together, they were not secured together, allowing careless builders to misalign the blocks and expose the underlying building to the elements. The wedge-lock quoin corner assembly disclosed herein, composed of locking quoin blocks, solves these problems.

The locking quoin block of the present invention is made of a resilient, semi-rigid polymeric material. It is advantageously produced as a unitary product, molded as a single piece, though alternative embodiments may be assembled from separate parts. In preferred embodiments, the material is calcium-carbonate-filled, UV-stabilized, no-break co-polymer polypropylene. In some embodiments, the material is a vinyl polymeric material suitable for exterior construction.

My locking quoin block includes locks that are configured to join vertically adjacent blocks without needing to use for this purpose additional connecting tools (such as hammers or screwdrivers) or connecting means (such as nails, glue, screws, bolts, staples, etc.). The locks ensure the blocks are properly aligned and securely connected prior to installation and throughout the useful life of the structure.

The methods of locking such blocks, of unlocking them when disassembly is required, and of the installation of them on buildings are further aspects of my present invention.

My invention provides a locking quoin block for assembling a column to be secured to a corner of a structure. The block comprises a sheet of semi-rigid polymeric material (e.g. polypropylene copolymer, vinyl, or other suitable formulation), the sheet formed as a pair of wings connected at a right angle along a corner axis, each wing having a top edge, a bottom edge, a vertical distal edge, and an exterior surface. A side flange (adapted to be nailed to the structure, optionally provided with holes for nails) extends from the distal edge of each wing. A vertical groove, adapted to mate with the ends of typical siding, is provided in the distal edge.

The exterior surface of each wing desirably produces the look of a traditional quoin corner by having a raised portion, below which is a recessed portion bounded by the bottom edge of each wing. Alternative embodiments of my invention may be designed to have wings with a generally planar exterior surface, or some other configuration for a different visual effect.

The top edge of each pair of wings has a horizontal groove bounded by a pair of interior groove surfaces that are substantially vertical. A horizontal lip extends from the top of one of the interior groove surfaces over and above the groove and is somewhat spaced apart from the other of the interior groove surfaces.

A ridge extends from the bottom edge of each pair of wings. The ridge has a front surface. The ridge and the horizontal groove are constructed so that when the ridge of a first block of my invention is inserted downwardly into the horizontal groove of a second block, they will matingly engage.

My invention provides a locking function by providing at least one wedge extending from the front surface of the ridge below each wing, configured so that, when force is applied to insert the ridge of the first block into the horizontal groove of the second block, the wedges deform the lip over the top edge of the horizontal groove, permitting the wedges to slide past the lip and to continue to a position where the lip is entrapped between the top of each wedge and the bottom edges of the wings, whereby the ridge of the first block matingly engages with the groove of the second block, and the two blocks are locked together.

In some embodiments of the invention, there are four wedges, two on each wing of the block, and other configurations may optionally be designed if desired. In some embodiments, the wedges have a regular trapezoidal shape when the wing is viewed from the front, i.e., with two pairs of congruent angles. Desirably the wedges are thickest at the top in the center and thinnest on the bottom and sides.

The method of locking a pair of my quoin blocks involves aligning the bottom of an upper block with the top of a lower block, then applying force to bring the blocks together so that portions of the lip extending horizontally above the lower block are entrapped by the wedges to the upper block, while the ridge of the upper block matingly engages the groove of the lower block.

The method of unlocking two locked quoin blocks, such as for repair or to cure a mistake in assembly, involves deforming a portion of the side of a wing of a lower block near its top edge, then applying force to an upper block, as if to turn the upper block's top edges towards the lower block's exterior surfaces.

In preferred embodiments of the invention, the method of installing the blocks as a quoin corner of a building structure involves creating a secure column or tower of blocks through repeated use of the aforementioned locking method until the desired number of blocks is reached, aligning the column with the building, and then attaching the column to the building, generally with nails. If required by the height or other characteristics of the construction, the installer may modify one or more of the blocks, preferably the bottom one, by cutting off a portion.

Optionally, each of the blocks of the present invention (or in certain instances, just the topmost block of a particular column) would be provided with a top flange adapted to be secured to the top of the corner of the structure by nails, screws, or other means of attachment.

My invention includes the method of assembling a column of locked-together quoin corner blocks. This method is performed by aligning the ridge of a first locking quoin block with the horizontal groove on the top edges of a second locking quoin block; and applying force (e.g. manually or by suitable mechanical means) to cause the ridge of the first block to enter the horizontal groove on the top edges of the second block, so that the wedges deform the lip of the horizontal groove, permitting the wedges to slide past the lip and to continue to a position where the lip is entrapped between the top of each wedge and the bottom edges of the wings, whereby the two blocks are locked together. These steps are repeated until the predetermined number of blocks for an assembly are locked into an assembled column, ready for attaching to the corner of a building structure.

As mentioned above, sometimes it will be desired to detach one or more blocks from an already-constructed column. In that event, my invention provides the following method: applying force to deform the distal edge of a wing of the lower block near a groove of the top edge, the force directed away from the exterior surface of the wing; and applying force to the upper block, the force directed as if turning the top edges of the upper block towards the exterior surfaces of the lower block.

In addition, my invention includes a preferred method of installing a column of my blocks as the corner of a building structure. First an installer determines the desired height of a column of locking quoin blocks and then shapes a first such block to fit a column to the building. Then the installer aligns the ridge of a second such block with the horizontal groove on the top edges of the first block and applies force to cause the ridge of the second block to enter the horizontal groove on the top edges of the first block, so that the wedges deform the lip of the horizontal groove, permitting the wedges to slide past the lip and to continue to a position where the lip is entrapped between the top of each wedge and the bottom edges of the wings, whereby the two blocks are mated as described above and remain locked together. The installer then repeats the step with a third block and as many additional blocks as are appropriate until the desired height of the column is achieved. Then the column of locked-together quoin corner blocks of my invention are secured to the building structure by conventional means such as nails, screws or an appropriate formulation of glue.

Desirably, two or more corners of a building structure are provided with quoin corner assemblies of my present invention, and polymer siding or other cladding (e.g. of vinyl, polypropylene or other desired material) is installed between them. This is achieved in accordance with my invention by inserting an end of a panel of the cladding into the groove of a distal edge of a locking quoin corner of the assembled and mounted column and nailing or otherwise securing the panel of cladding to the building structure.

Typically, an installer would repeat the previously described steps to mount another assembled column to another corner of the building, so that the two columns are at opposite ends of a wall of the building structure, and panels of cladding would be installed between both columns of quoin corner blocks. The ends of those panels of cladding that are coterminous with the ends of the structure defining the wall between the columns would be inserted matingly into the respective grooves of a distal edge of a second locking quoin corner of the second assembled column constituting a quoin corner assembly of the present invention.

Another aspect of the present invention is a quoin block comprising a sheet of semi-rigid polymeric material, the sheet being formed as a pair of wings, the pair of wings comprising a first wing and a second wing connected at a right angle along a corner axis, each wing having a top edge, a bottom edge, a distal edge, and an exterior surface;

a side flange extending from the distal edge of each wing, the side flange being adapted to be nailed to a structure; the exterior surface of each wing having a raised portion and a recessed portion bounded by the bottom edge of each wing; the distal edge of each wing being parallel to the corner axis and having a vertical groove; the top edge of each pair of wings having a horizontal groove with a horizontal lip formed over the groove; a ridge extending from the bottom edge of each pair of wings, the ridge having a front surface; the ridge and the horizontal groove being adapted to matingly engage when the ridge of a first locking quoin block is inserted into the horizontal groove of a second locking quoin block, the improvement which comprises providing locking functionality supplied by the addition of two wedges extending from the front surface of the ridge below each wing, the wedges configured so that, when force is applied to insert the ridge of the first block into the horizontal groove of the second block, the wedges deform the lip over the top edge of the horizontal groove, permitting the wedges to slide past the lip and to continue to a position where the lip is entrapped between the top of each wedge and the bottom edges of the wings, whereby the two blocks are locked together.

DETAILED DESCRIPTION

Figure 1:
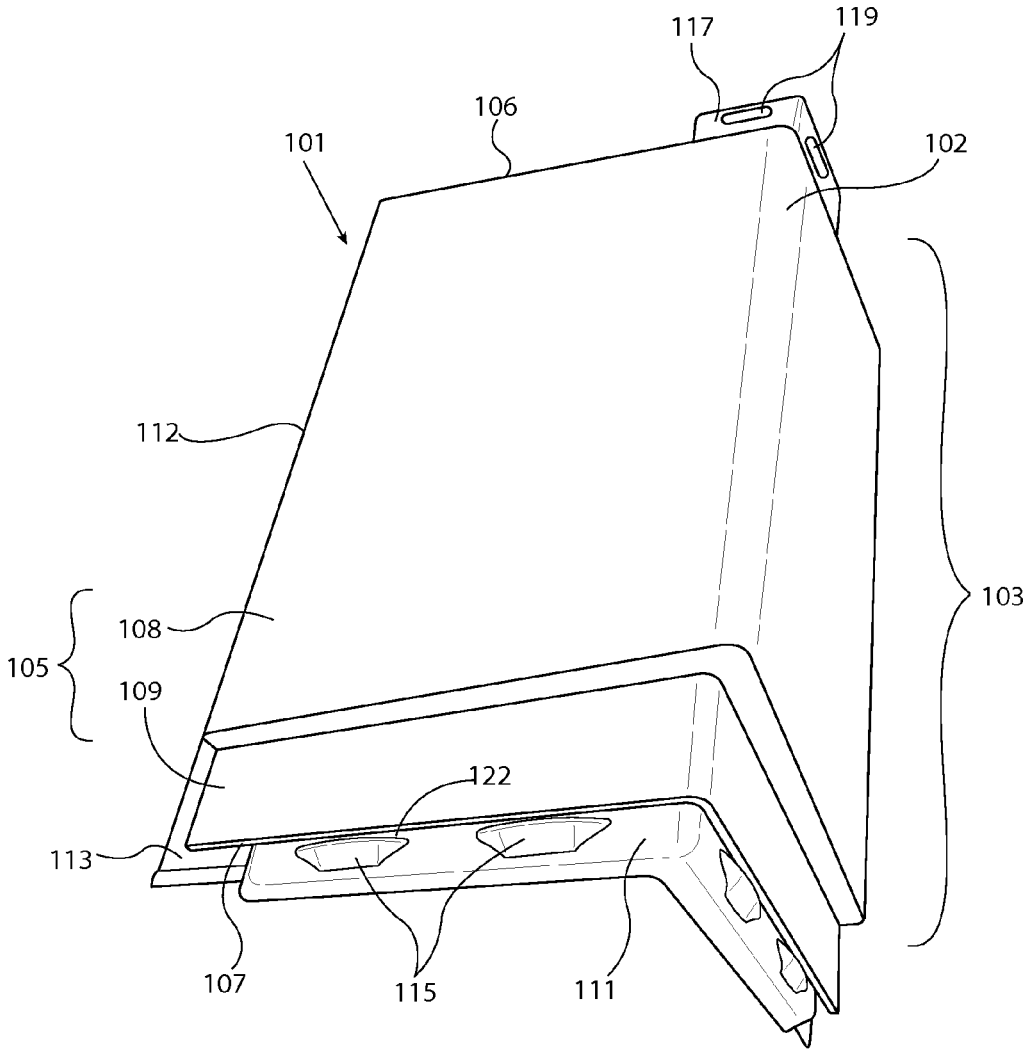
FIG. 1 is a perspective view of a locking quoin block of the present invention, looking upwards from below the block.

With reference to the accompanying drawings, FIG. 1 shows an example of a locking quoin block 101 of my invention, with two wings 103 extending at right angles from a corner axis 102. Each of the wings 103 has a top edge 106, a bottom edge 107, a side flange 113 extending from its distal edge 112, and an exterior surface 105. The exterior surface 105 includes a raised portion 108 and a recessed portion 109. (Alternatively, the exterior surface may have a continuous decorative portion.) Also shown is a ridge 111 extending from the bottom edge 107 of the wing, from which two wedges 115 protrude. There is a slot 122 between the top of the wedge 115 and the bottom edge 107.

In the embodiment illustrated, the faces of wedges 115 are shaped as regular trapezoids (i.e., having two pairs of congruent angles), with the long edge of the trapezoid at the top of the wedge and the short edge at the bottom. The wedges 115 are desirably shaped to be thickest at the top center of the wedge, and thinner at the wedge's sides and bottom. The wedges 115 are further shaped so that the top of the wedge is parallel to the bottom edge 107. Also shown is a top flange 117 extending upwardly from portions of the wings 103 near the corner axis 102. The top flange 117 is provided with holes 119 for permitting nails, screws or the like to attach the quoin block 101 to the corner of a supporting structure.

In alternative embodiments of the invention, the number of wedges 115 on each wing 103 may be as few as one or as many as three, four or more for increased locking strength. The faces of each wedge 115 need not be trapezoidal, e.g., they could be rectangular or semi-circular or triangular. In alternative embodiments, the thickness distribution of the wedges 115 may also be different from the illustrated embodiment, i.e., the sides may be as thick as the center. In preferred embodiments, the wedges 115 are integrally molded to the ridges 111.

Typically the corner axis 102 of each block is 12 inches in length, which defines the uniform height of each locking quoin block 101. The length of each of the wings 103 (that is, from corner axis 102 to distal edge 112) is also typically 12 inches, but may be any length deemed by the designer to be visually pleasing and structurally sound. Typically the raised portion 108 is 10 inches long along the corner axis 102, and the recessed portion 109 is 2 inches long along the corner axis 102, but other design choices may be made as desired. The raised portion 108 is also typically raised 0.5 inches past the recessed portion 109, and recessed portion itself is typically raised 0.125 inches past the front surface of the ridge 111.

In other embodiments of the invention, the illustrated top flange 117 may be omitted when the locking quoin block 101 is formed. Alternatively, top flange 117 may be removed from a locking quoin block.

Figure 2:
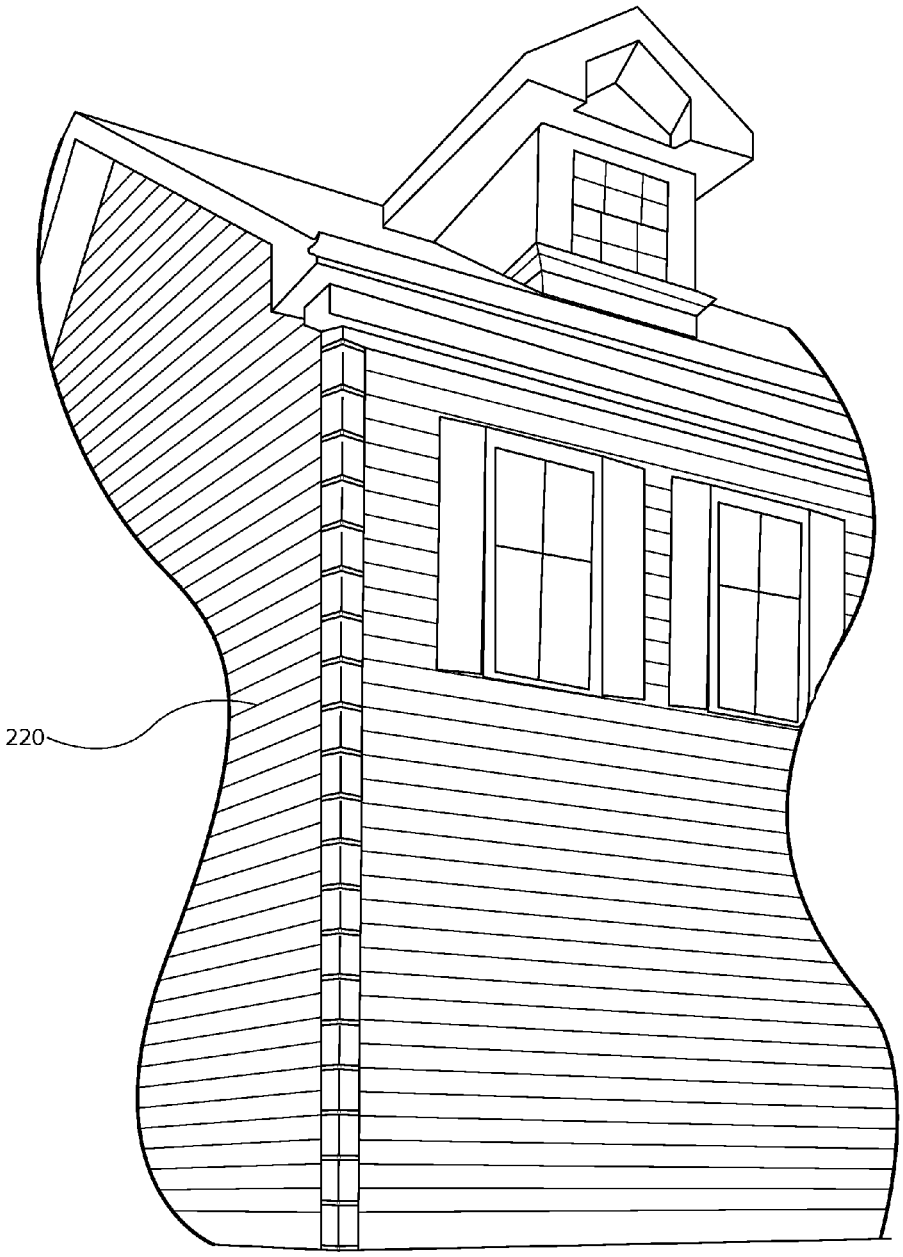
FIG. 2 is a perspective view of locking quoin blocks of the present invention after being assembled into a column and attached to a building.

FIG. 2 shows an example of a vinyl siding residential structure to which an assembled column of locking quoin blocks 220 have been attached.

Figure 3A:
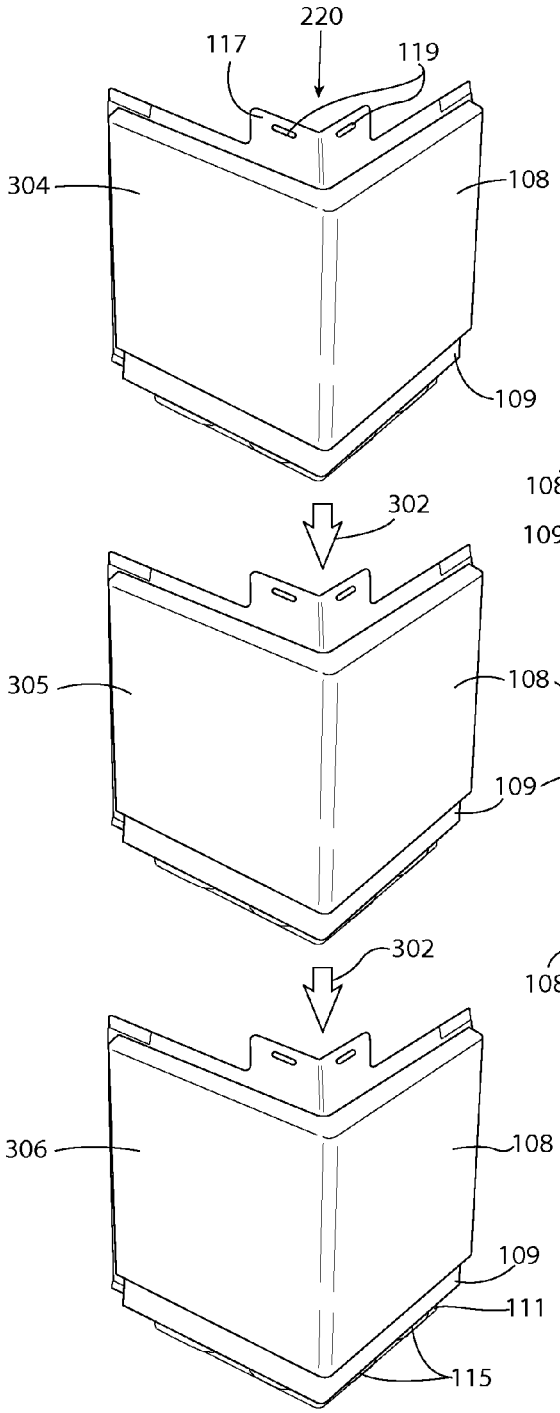
FIGS. 3*a* and 3*b* are perspective views figuratively depicting the assembly of three locking quoin blocks into an assembled column.
Figure 3B:
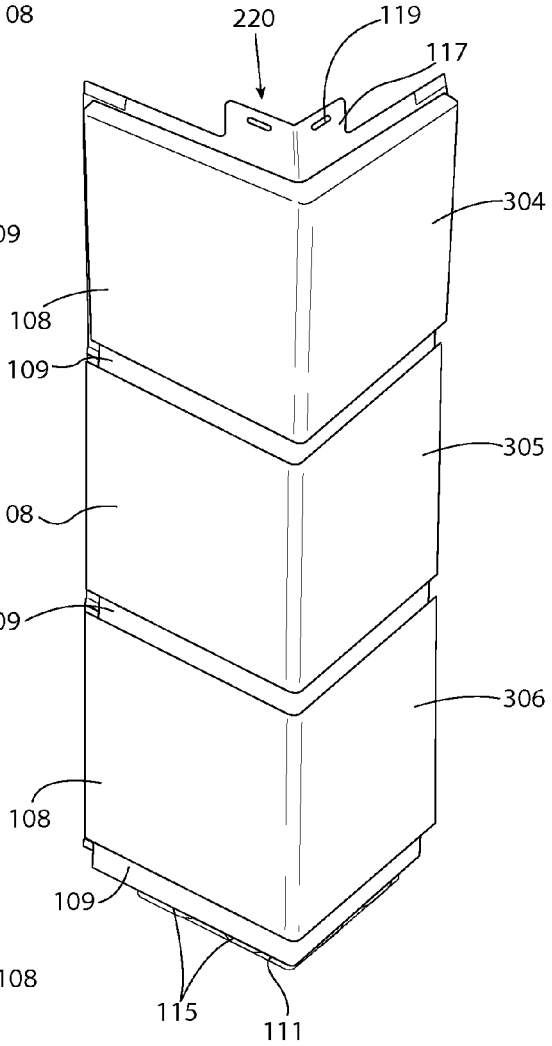

FIGS. 3*a* and 3*b* show how a set of locking quoin blocks 220 are adapted to be assembled into a column in accordance with the present invention. Once assembled, the locking quoin blocks resist separation, making the column rigid enough to be used as one piece. FIG. 3*a* shows three separate blocks 220 and the direction that force should be applied in order to lock the blocks together, shown here as locking force 302. A locking force 302 is applied (manually or mechanically) to connect the middle block 305 to the bottom block 306, and locking force 302 is also applied to connect the top block 304 to the middle block 305. Typically, the bottom two blocks are first joined by the application of locking force 302, then another block is joined atop the column that was created by the initial application of locking force 302, and so on up the column until the topmost block has been thereby joined to form a completed column of locking quoin blocks 220, such as is shown in FIG. 3*b*. The installer will then secure the column to the building, by nailing the column to the building through the side flanges of its blocks.

The exterior surfaces of the locking quoin blocks which together constitute the column 220 show alternating raised portions 108 and recessed portions 109. The raised portions 108 are desirably formed to resemble stone blocks. The recessed portions 109 are formed to resemble a surface of recessed stone.

FIG. 3*b* also shows the ridges 111 and the wedges 115 on the bottom block 306 of the column 220, whereas the ridges 111 and wedges 115 of the other blocks 304, 305 are no longer visible, as they would have been before assembly, e.g., as shown in FIG. 3*a*.

FIG. 3*b* shows the top flange 117 with its holes 119 on the top block 304 of the column 220, and also shows that the top flanges 117 of the other blocks 305, 306 are no longer exposed, as they would have been before assembly, e.g., as shown in FIG. 3*a*. Optionally, the blocks of the present invention may be assembled in any desired order. Note that the three blocks shown in FIGS. 3*a* and 3*b* are representative of any number of desired blocks, depending on the height of the column to be provided with a quoin corner assembly in accordance with the present invention.

Figure 6A:
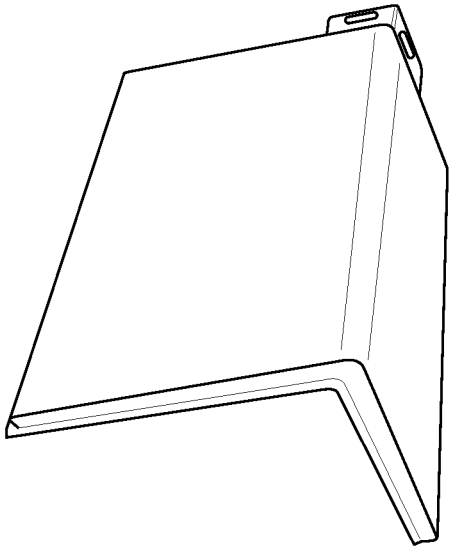
FIG. 6*a* is a perspective view of a locking quoin block of the present invention showing a bottom block for an assembled column.
Figure 6B:
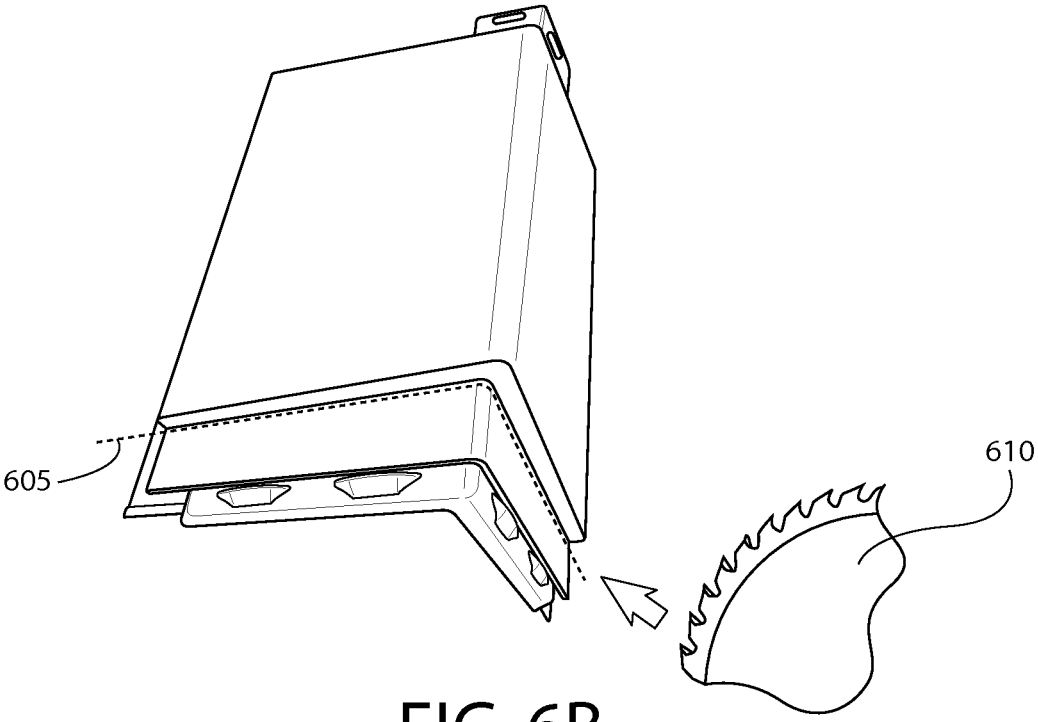
FIG. 6*b* is a perspective view of a locking quoin block of the present invention showing the cutting of a block which an installer desires to shorten.

As previously mentioned, each of the blocks 304, 305, 306 is of a uniform height, typically 12 inches. To construct an assembly with a height that is other than an integral number of feet, an installer would desirably trim an appropriate height off the bottom-most block, here shown as block 306. As will be discussed below, such a trim is depicted in FIGS. 6*a* and 6*b*.

Figures 4A, 4B, 4C:
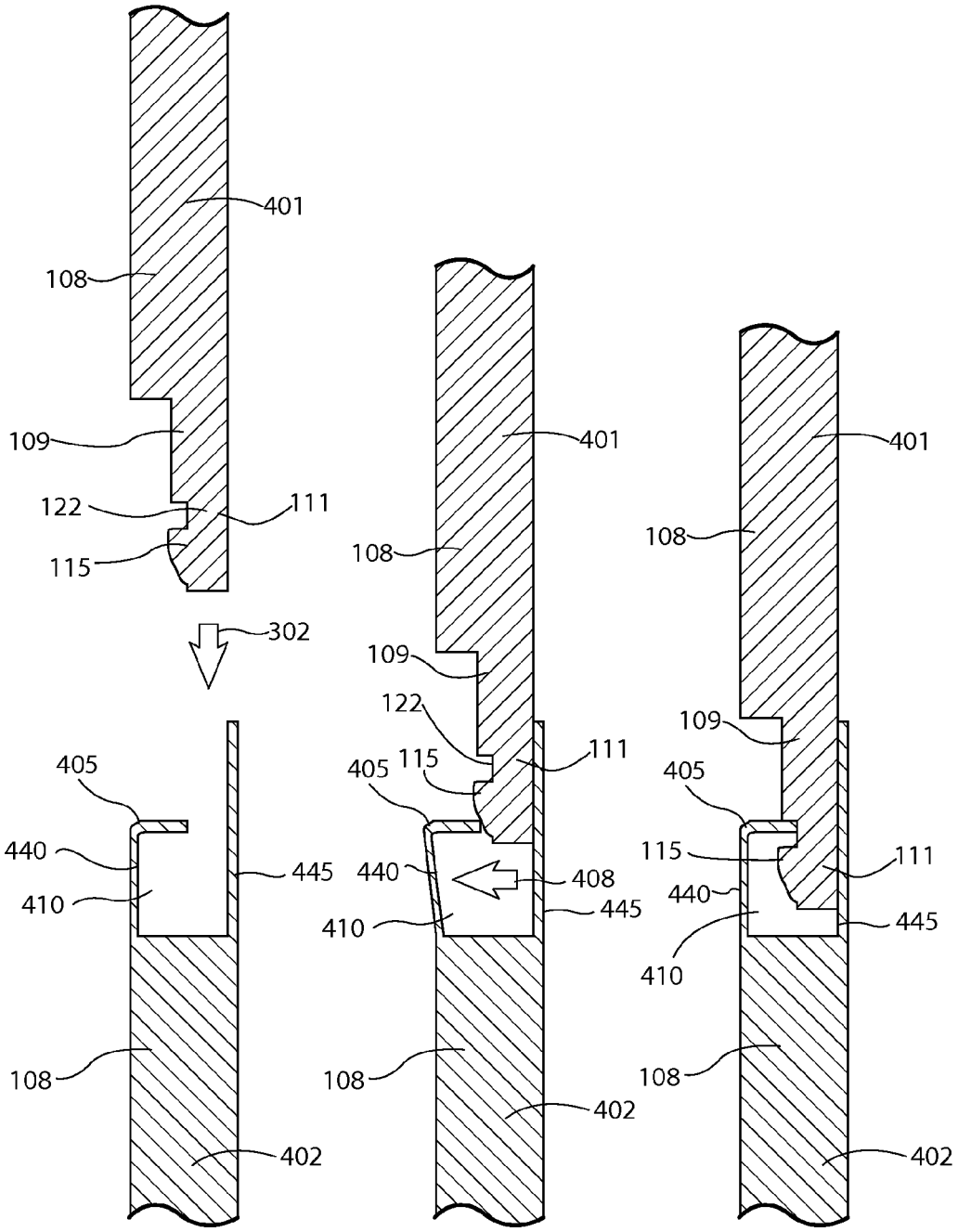
FIGS. 4*a*, 4*b*, and 4*c* are partial vertical cross-sections of a pair of locking quoin blocks showing successive steps in their assembly and locking together.

FIGS. 4*a*, 4*b* and 4*c* show a partial cross-section (that is, a close-up) of successive positions of locking elements during the assembly of a column of locking quoin blocks of the present invention. Each of FIGS. 4*a*, 4*b* and 4*c* shows an upper locking quoin block 401 and a lower locking quoin block 402 that have been positioned in proper alignment for locking. Also shown are parts of the raised portions 108 of the upper locking quoin block 401 and the lower locking quoin block 402, the recessed portion 109 of the upper locking quoin block 401, the ridge 111 on the bottom edge 107 of the upper locking quoin block 401 with one of its wedges 115, and the groove 410 with a front wall 440 and a back wall 445. Also shown is a lip 405 extending over the groove from the front wall 440. The groove 410 and the ridge 111 are made so that they matingly engage when the ridge 111 is inserted in the groove 410. Also shown is the slot 122 between the wedge 115 and the bottom edge 107, where the lip 405 will be entrapped. In preferred embodiments, the lip 405 is about 0.125 inches thick, and the slot 122 is about 0.125 inches wide.

FIG. 4*a* shows a first position, when an installer is beginning to apply locking force 302 intended to connect the upper locking quoin block 401 and the lower locking quoin block 402.

FIG. 4*b* shows a successive position of these elements, wherein the lip 405 extending from the front wall 440 of the groove 410 is pushed by the wedge 115 and thereby caused to temporarily deform a tiny amount in the direction of the arrow 408, allowing the wedge 115 to slide by in the downward direction.

FIG. 4*c* shows the final respective position of these elements, wherein the blocks have become locked together. Note that as soon as the wedge 115 has passed downwardly below the edge of lip 405, the lip 405 snaps back, attempting to return to its original position and shape. In preferred embodiments, this locking movement of lip 405 produces an audible click. A benefit of my invention is that this click signals to the construction installer that the pair of blocks have become locked together and that no further locking force 302 need be applied. The lip 405 is now trapped in the slot 122 between the wedge 115 and the bottom of the recessed portion 109. The ridge 111 is locked into the groove 410.

Figure 5:
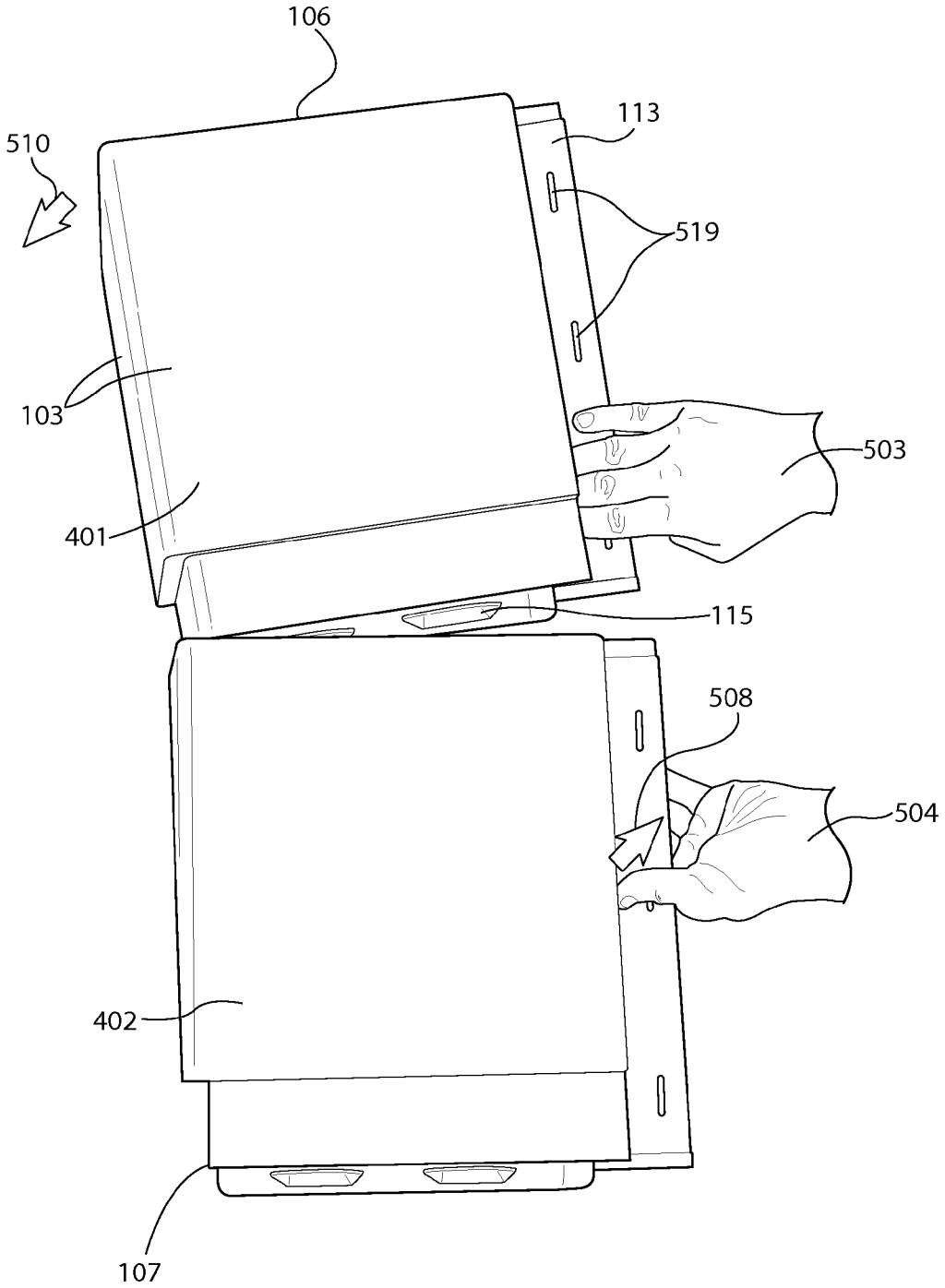
FIG. 5 shows how a pair of locked quoin blocks may be disassembled.

However, all work does not necessarily proceed smoothly at every construction site. One of the blocks may become damaged and so need to be replaced before the column is secured to the corner of the structure. Or perhaps the height wasn't properly measured at first. So my invention also includes a method for unlocking a pair of locked quoin blocks. As shown in FIG. 5, two locking quoin blocks, an upper block 401 and a lower block 402, were locked together but are being undone. In the move shown here, an installer uses the left hand 504 to apply a deforming force 508 to the side flange 113 of the lower locking quoin block 402. Note the holes 519 in the side flange 113 for securing the block to a building. The deforming force 508 deforms the side flange 113 of the lower locking quoin block 402 towards the fingers of the installer's left hand 504. The installer simultaneously uses the right hand 503 to apply a turning force 510 to the upper locking quoin block 401. As depicted in this FIG. 5, the turning force 510 is counter-clockwise, the installer trying to bring the top edges 106 of the wings 103 of the upper locking quoin block 401 towards the bottom edges 107 of the lower locking quoin block 402. The wedges 115 of the upper block 401 are now visible.

Note that that the installer may similarly unlock a pair of quoin blocks of the present invention by using different hand positions and/or reversing the roles of the left and right hands by flipping the blocks over.

Note also that in the embodiment of quoin blocks 401 and 402 shown in FIG. 5, there is no structure corresponding to top flange 117 of some other of the embodiments shown. As mentioned above, such a top flange is optional.

FIGS. 6*a* and 6*b* show alternative versions of a bottom block for a column of locking quoin blocks.

FIG. 6*a* shows a locking quoin block 101 that has been manufactured without the recessed portions, ridges, or wedges as shown in other embodiments. This would desirably provide a wider bottom so that the block may rest on the ground more stably, to supporting a higher column than otherwise.

In FIG. 6*b*, a cut line 605 shows where an installer may provide a locking quoin block such as in any of the previously described embodiments, and then trim away the lowermost section, e.g. removing the recessed portions, ridges, and wedges. This step could be performed in order to create a wider bottom edge for supporting the column while it is being affixed to the structure and/or simply to match the height of the column of quoin blocks to the height of the structure. (The style of the depicted cutting element 610 is for illustration and not limitation.) Those skilled in the art will be familiar with appropriate cutting methods.

Figure 7:
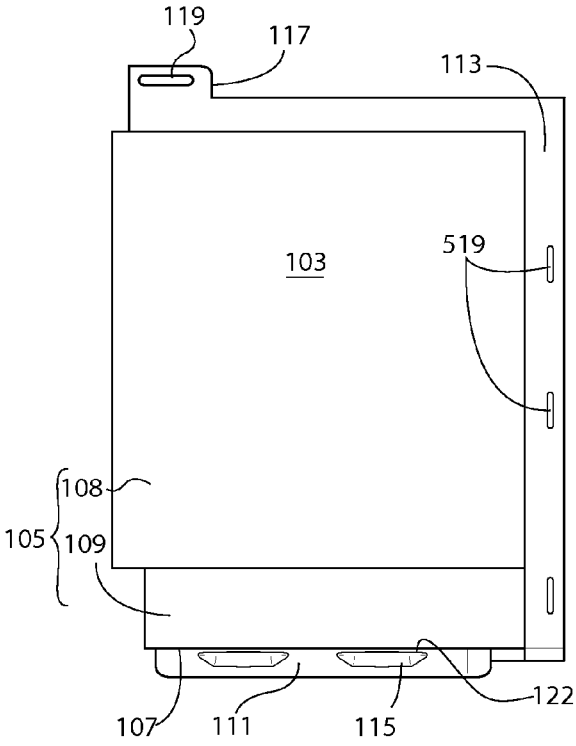
FIG. 7 is an elevation view of a locking quoin block of the present invention, looking at the exterior surface of a wing.

FIG. 7 shows an elevation view of a locking quoin block, facing the exterior surface 105 of a wing 103. This locking quoin block has been manufactured with the optional top flange 117 and its holes 119 for receiving attachment means. Also shown is a ridge 111 with its wedges 115. The side flange 113 is visible, as is the side flange's holes 519 for permitting nails, screws, and the like for securing the block to a building. The raised portion 108 and recessed portion 109 are also clearly visible. The bottom edge 107 and the top of the wedges 115 form the slot 122 where the lip of another locking quoin block will be entrapped.

Figure 8:
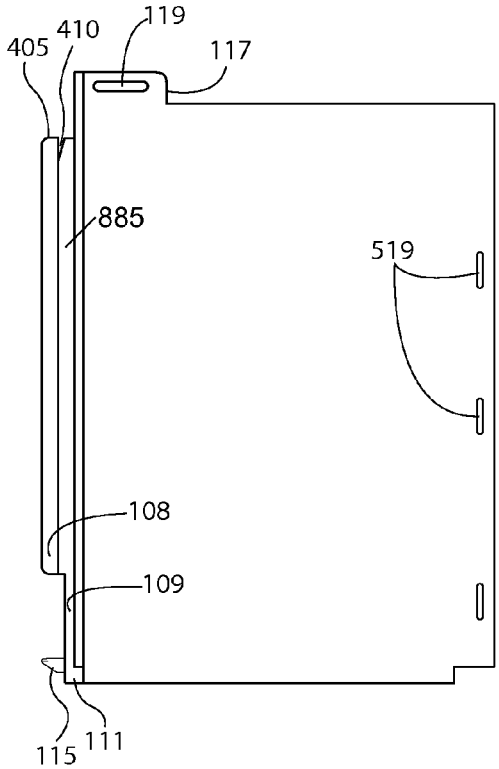
FIG. 8 is an elevation view of a locking quoin block of the present invention, looking along the side flange into the distal edge of a wing.

FIG. 8 shows an elevation view of a locking quoin block, facing the side flange. The back of the wing is visible. This locking quoin block has been manufactured with the optional top flange 117 and its holes 119 for receiving attachment means. Also shown is a ridge 111 with its wedges 115. The side flange 113 is visible, as is the side flange's holes 519 for permitting nails, screws, and the like for securing the block to a building. The raised portion 108 and recessed portion 109 are shown. The groove 410 with its lip 405 is also shown.

Figure 9:
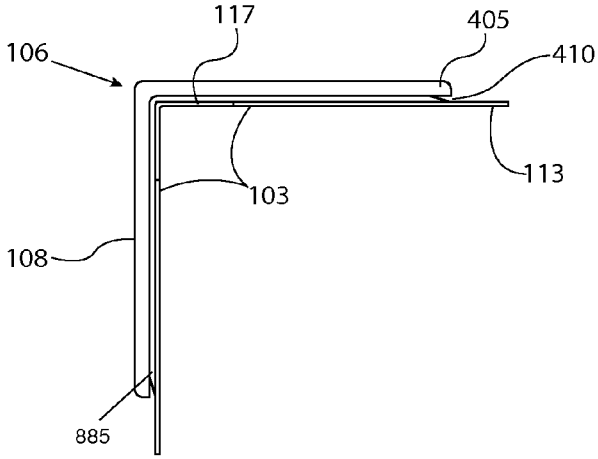
FIG. 9 is a plan view from the top of a locking quoin block of the present invention.

FIG. 9 is a plan view of a locking quoin block of the present invention. The wings 103 are set at right angles to each other along a corner axis 102. The top edges 106 of the wings are visible. The raised portion 108 of the wing 103 is visible. The groove 410 with its lip 405 is shown. The top of the side flange 113 is also shown. Also shown is the top of the top flange 117.

While preferred embodiments of the disclosed subject matter have been described, so as to enable one skilled in the art to practice the disclosed subject matter without undue experimentation, the preceding description is intended to be exemplary. It is not intended to limit the scope of the invention as recited in the appended claims.

FIGS. 8 and 9 also show the vertical groove 885, which is adapted to mate with the ends of typical siding. To install siding, an installer inserts an end of a panel of siding into the vertical groove 885 of an assembled and mounted column, then secures the panel of siding to the building structure, typically by nailing.

I claim:

1. A locking quoin block for assembling into a column to be secured to a corner of a structure, comprising:

a sheet of semi-rigid polymeric material, the sheet being formed as a pair of wings, the pair of wings comprising a first wing and a second wing connected at a right angle along a corner axis, each wing having a top edge, a bottom edge, a distal edge, and an exterior surface;

a side flange extending from the distal edge of each wing, the side flange being adapted to be nailed to a structure;

the exterior surface of each wing having a decorative portion bounded by the bottom edge of each wing;

the distal edge of each wing being parallel to the corner axis and having a vertical groove;

the top edge of each pair of wings having a horizontal groove with a horizontal lip formed over the groove and spaced apart from the top of one side of the groove;

a ridge extending from the bottom edge of each pair of wings, the ridge having a front surface;

the ridge and the horizontal groove being adapted to matingly engage when the ridge of a first locking quoin block is inserted into the horizontal groove of a second locking quoin block;

at least one wedge extending from the front surface of the ridge below each wing, configured so that, when force is applied to insert the ridge of the first block into the horizontal groove of the second block, the at least one wedge deforms the lip over the top edge of the horizontal groove, permitting the at least one wedge to slide past the lip and to continue to a position where the lip is entrapped between the top of each wedge and the bottom edges of the wings, whereby the two blocks are locked together.

2. The locking quoin block of claim 1, wherein the semi-rigid polymeric material is a semi-rigid formulation of polypropylene.

3. The locking quoin block of claim 1, further comprising a top flange extending vertically at the corner axis from at least a portion of the top edge of each wing, the top flange being adapted to be nailed to a structure.

4. A method for assembling a column of locking quoin blocks, the locking quoin blocks comprising:

a sheet of semi-rigid polymeric material, the sheet formed as a pair of wings, the pair of wings comprising a first wing and a second wing connected at a right angle along a corner axis, each wing having a top edge, a bottom edge, a distal edge, and an exterior surface;

a side flange extending from the distal edge of each wing, the side flange being adapted to be nailed to a structure;

the exterior surface of each wing having a decorative portion bounded by the bottom edge of each wing;

the distal edge of each wing being parallel to the corner axis and having a vertical groove;

the top edge of each pair of wings having a horizontal groove with a horizontal lip formed over the groove;

a ridge extending from the bottom edge of each pair of wings, the ridge having a front surface;

the ridge and the horizontal groove being adapted to matingly engage when the ridge of a first locking quoin block is inserted into the horizontal groove of a second locking quoin block;

at least one wedge extending from the front surface of the ridge below each wing, the method comprising:

aligning the ridge of a first locking quoin block with the horizontal groove on the top edges of a second locking quoin block; and applying force to cause the ridge of the first block to enter the horizontal groove on the top edges of the second block, so that the at least one wedge deforms the lip of the horizontal groove, permitting the at least one wedge to slide past the lip and to continue to a position where the lip is entrapped between the top of each wedge and the bottom edges of the wings, whereby the two blocks are locked together; and repeating the previous steps until the predetermined number of blocks for an assembly are locked together.

5. The method of claim 4, wherein the force is manually applied.

6. A method for unlocking a locked pair of locking quoin blocks, each of the blocks comprising:

a sheet of semi-rigid polymeric material, the sheet formed as a pair of wings, the pair of wings comprising a first wing and a second wing connected at a right angle along a corner axis, each wing having a top edge, a bottom edge, a distal edge, and an exterior surface;

a side flange extending from the distal edge of each wing, the side flange being adapted to be nailed to a structure;

the exterior surface of each wing having a decorative portion bounded by the bottom edge of each wing;

the distal edge of each wing being parallel to the corner axis and having a vertical groove;

the top edge of each pair of wings having a horizontal groove with a horizontal lip formed over the groove;

a ridge extending from the bottom edge of each pair of wings, the ridge having a front surface;

the ridge and the horizontal groove being adapted to matingly engage when the ridge of a first locking quoin block is inserted into the horizontal groove of a second locking quoin block;

at least one wedge extending from the front surface of the ridge below each wing, the method comprising:

applying force to deform the distal edge of a wing of the lower block near a groove of the top edge, the force directed away from the exterior surface of the wing; and applying force to the upper block, the force directed as if turning the top edges of the upper block towards the exterior surfaces of the lower block.

7. A method for installing an assembly of locking quoin blocks at the corner of a building structure, each of the blocks comprising:

a sheet of semi-rigid polymeric material, the sheet formed as a pair of wings, the pair of wings comprising a first wing and a second wing connected at a right angle along a corner axis, each wing having a top edge, a bottom edge, a distal edge, and an exterior surface;

a side flange extending from the distal edge of each wing, the side flange being adapted to be nailed to a structure;

the exterior surface of each wing having a decorative portion bounded by the bottom edge of each wing;

the distal edge of each wing being parallel to the corner axis and having a vertical groove;

the top edge of each pair of wings having a horizontal groove with a horizontal lip formed over the groove;

a ridge extending from the bottom edge of each pair of wings, the ridge having a front surface;

the ridge and the horizontal groove being adapted to matingly engage when the ridge of a first locking quoin block is inserted into the horizontal groove of a second locking quoin block;

at least one wedge extending from the front surface of the ridge below each wing, the method comprising:

determining the desired height of a column of locking quoin blocks;

shaping a first locking quoin block to fit a column to the building;

aligning the ridge of a second locking quoin block with the horizontal groove on the top edges of the first block;

applying force to cause the ridge of the second block to enter the horizontal groove on the top edges of the first block, so that the at least one wedge deforms the lip of the horizontal groove, permitting the at least one wedge to slide past the lip and to continue to a position where the lip is entrapped between the top of each wedge and the bottom edges of the wings, whereby the two blocks are locked together;

repeating the previous steps until the predetermined number of blocks for an assembly are locked together;

securing the assembled column to the building structure.

8. The method of claim 7, further comprising:

inserting an end of a panel of cladding matingly into the groove of a distal edge of a first locking quoin corner of the assembled column;

securing the cladding panel to the building; and repeating the previous step until the desired number of cladding panels is secured to the building.

9. In a quoin block comprising:

a sheet of semi-rigid polymeric material, the sheet formed as a pair of wings, the pair of wings comprising a first wing and a second wing connected at a right angle along a corner axis, each wing having a top edge, a bottom edge, a distal edge, and an exterior surface;

a side flange extending from the distal edge of each wing, the side flange being adapted to be nailed to a structure;

the exterior surface of each wing having a decorative portion comprising a raised portion and a recessed portion bounded by the bottom edge of each wing;

the distal edge of each wing being parallel to the corner axis and having a vertical groove;

the top edge of each pair of wings having a horizontal groove with a horizontal lip formed over the groove;

a ridge extending from the bottom edge of each pair of wings, the ridge having a front surface;

the ridge and the horizontal groove being adapted to matingly engage when the ridge of a first locking quoin block is inserted into the horizontal groove of a second locking quoin block, the improvement which comprises:

locking functionality supplied by the addition of two wedges extending from the front surface of the ridge below each wing, the wedges configured so that, when force is applied to insert the ridge of the first block into the horizontal groove of the second block, the wedges deform the lip over the top edge of the horizontal groove, permitting the wedges to slide past the lip and to continue to a position where the lip is entrapped between the top of each wedge and the bottom edges of the wings, whereby the two blocks are locked together.

10. The locking quoin block of claim 9, further comprising a top flange extending vertically at the corner axis from at least a portion of the top edge of each wing, the top flange being adapted to be nailed to a structure.

* * * * *